US009931729B2

(12) United States Patent
Lefevre et al.

(10) Patent No.: US 9,931,729 B2
(45) Date of Patent: Apr. 3, 2018

(54) POLISHING PAD WITH GROOVED FOUNDATION LAYER AND POLISHING SURFACE LAYER

(71) Applicant: NexPlanar Corporation, Hillsboro, OR (US)

(72) Inventors: Paul Andre Lefevre, Portland, OR (US); William C. Allison, Beaverton, OR (US); Diane Scott, Portland, OR (US); James P. LaCasse, Portland, OR (US)

(73) Assignee: Cabot Microelectronics Corporation, Aurora, IL (US)

( * ) Notice: Subject to any disclaimer, the term of this patent is extended or adjusted under 35 U.S.C. 154(b) by 81 days.

(21) Appl. No.: 14/727,586

(22) Filed: Jun. 1, 2015

(65) Prior Publication Data

US 2015/0266160 A1 Sep. 24, 2015

Related U.S. Application Data

(62) Division of application No. 13/306,849, filed on Nov. 29, 2011, now Pat. No. 9,067,298.

(51) Int. Cl.
*B24B 37/26* (2012.01)
*B24B 37/16* (2012.01)
(Continued)

(52) U.S. Cl.
CPC ..... *B24B 37/26* (2013.01); *B24B 37/16* (2013.01); *B24B 37/205* (2013.01); *B24B 37/22* (2013.01); *B24B 37/24* (2013.01); *B24D 18/00* (2013.01)

(58) Field of Classification Search
CPC ..... B24B 37/24; B24B 37/26; B24B 37/16; B24D 11/001; B24D 11/00; B24D 18/00; B24D 18/0072
See application file for complete search history.

(56) References Cited

U.S. PATENT DOCUMENTS 1,953,983 A 4/1934 Benner
5,007,207 A 4/1991 Phaal
(Continued)

FOREIGN PATENT DOCUMENTS

CN 101823242 9/2010
JP 2004243428 9/2004
(Continued)

OTHER PUBLICATIONS

International Preliminary Report on Patentability from PCT/US2012/038211 dated Jun. 12, 2014, 6 pgs.
(Continued)

*Primary Examiner* — Joseph J Hail
*Assistant Examiner* — Tyrone V Hall, Jr.
(74) *Attorney, Agent, or Firm* — Thomas Omholt; Erika S. Wilson

(57) ABSTRACT

Polishing pads with grooved foundation layers and polishing surface layers are described. In an example, a polishing pad for polishing a substrate includes a foundation layer having a pattern of grooves disposed therein. A continuous polishing surface layer is attached to the pattern of grooves of the foundation layer. In another example, a polishing pad for polishing a substrate includes a foundation layer with a surface having a pattern of protrusions disposed thereon. Each protrusion has a top surface and sidewalls. A non-continuous polishing surface layer is attached to the foundation layer and includes discrete portions. Each discrete portion is attached to the top surface of a corresponding one of the protrusions of the foundation layer. Methods of fabricating polishing pads with a polishing surface layer bonded to a grooved foundation layer are also described.

23 Claims, 7 Drawing Sheets

(51) Int. Cl.

| | |
|---|---|
| ***B24B 37/24*** | (2012.01) |
| ***B24B 37/20*** | (2012.01) |
| ***B24B 37/22*** | (2012.01) |
| ***B24D 18/00*** | (2006.01) |

(56) References Cited

U.S. PATENT DOCUMENTS

| | | | | |
|---|---|---|---|---|
| 5,014,468 | A | 5/1991 | Ravipati et al. | |
| 5,190,568 | A | 3/1993 | Tselesin | |
| 5,212,910 | A | 5/1993 | Breivogel et al. | |
| 5,391,210 | A | 2/1995 | Bilkadi et al. | |
| 5,453,106 | A | 9/1995 | Roberts | |
| 5,609,517 | A | 3/1997 | Lofaro | |
| 5,709,598 | A | 1/1998 | Nishio et al. | |
| 5,823,855 | A * | 10/1998 | Robinson | B24B 37/24 451/285 |
| 5,893,796 | A | 4/1999 | Birang et al. | |
| 5,921,855 | A | 7/1999 | Osterheld et al. | |
| 5,958,794 | A | 9/1999 | Bruxvoort et al. | |
| 6,019,666 | A | 2/2000 | Roberts et al. | |
| 6,089,965 | A | 7/2000 | Otawa et al. | |
| 6,106,382 | A | 8/2000 | Sakaguchi | |
| 6,179,887 | B1 | 1/2001 | Barber, Jr. | |
| 6,183,346 | B1 | 2/2001 | Gagliardi et al. | |
| 6,194,317 | B1 | 2/2001 | Kaisaki et al. | |
| 6,217,426 | B1 | 4/2001 | Tolles et al. | |
| 6,299,508 | B1 | 10/2001 | Gagliardi et al. | |
| 6,413,153 | B1 | 7/2002 | Molar | |
| 6,454,634 | B1 | 9/2002 | James et al. | |
| 6,498,101 | B1 | 12/2002 | Wang | |
| 6,544,306 | B2 | 4/2003 | Suzuki et al. | |
| 6,544,373 | B2 | 4/2003 | Chen et al. | |
| 6,575,825 | B2 | 6/2003 | Tolles et al. | |
| 6,736,709 | B1 | 5/2004 | James et al. | |
| 6,838,169 | B2 | 1/2005 | Obeng | |
| 6,884,156 | B2 | 4/2005 | Prasad et al. | |
| 7,029,747 | B2 | 4/2006 | Huh et al. | |
| 7,169,029 | B2 * | 1/2007 | Petersen | B24D 15/04 451/523 |
| 7,198,549 | B2 | 4/2007 | Steckenrider et al. | |
| 7,201,647 | B2 | 4/2007 | Lombardo et al. | |
| 7,235,114 | B1 | 6/2007 | Minick et al. | |
| 7,530,880 | B2 | 5/2009 | Bajaj et al. | |
| 7,846,008 | B2 | 12/2010 | Bajaj | |
| 2003/0207659 | A1 | 11/2003 | Annen et al. | |
| 2003/0217927 | A1 | 11/2003 | Basol et al. | |
| 2004/0248508 | A1 | 12/2004 | Lombardo | |
| 2004/0259484 | A1 | 12/2004 | Prasad et al. | |
| 2005/0032462 | A1 * | 2/2005 | Gagliardi | B24B 53/017 451/8 |
| 2007/0212979 | A1 * | 9/2007 | Preston | B24B 37/205 451/6 |
| 2009/0145045 | A1 | 6/2009 | Sung | |
| 2009/0176443 | A1 | 7/2009 | Kollodge et al. | |
| 2010/0317262 | A1 | 12/2010 | Boutaghou | |
| 2012/0009855 | A1 * | 1/2012 | Allison | B24B 37/205 451/527 |
| 2012/0302148 | A1 * | 11/2012 | Bajaj | B24B 37/205 451/527 |
| 2013/0137349 | A1 | 5/2013 | Lefevre et al. | |
| 2013/0137350 | A1 | 5/2013 | Allison et al. | |

FOREIGN PATENT DOCUMENTS

| | | |
|---|---|---|
| JP | 2006140240 | 6/2006 |
| JP | 2006239833 | 9/2006 |
| JP | 3851135 | 11/2006 |
| JP | 2007-044814 | 2/2007 |
| JP | 2007530297 | 11/2007 |
| JP | 2010005747 | 1/2010 |
| JP | 2010029996 | 2/2010 |
| JP | 2010528885 | 8/2010 |
| JP | 2011-67946 | 4/2011 |
| KR | 10-2006-0127219 | 12/2006 |
| TW | 220002 | 2/1994 |
| TW | 539596 | 7/2003 |
| TW | 541225 | 7/2003 |
| TW | I298667 | 7/2008 |
| WO | WO-2005/099962 | 10/2005 |
| WO | WO-2007104063 | 3/2007 |
| WO | WO-2008154185 | 12/2008 |

OTHER PUBLICATIONS

Non-Final Office Action from U.S. Appl. No. 13/113,655 dated Apr. 15, 2014, 9 pgs.
Non-Final Office Action from U.S. Appl. No. 13/113,655 dated Oct. 8, 2013, 7 pgs.
Non-Final Office Action for Japan Patent Application No. 2014-511502, dated Jul. 17, 2014, 8 pgs.
Final Office Action from U.S. Appl. No. 13/113,655 dated Jul. 31, 2014, 12 pgs.
Non-Final Office Action from U.S. Appl. No. 13/306,849 dated Oct. 1, 2014, 9 pgs.
Taiwan Search Report from Taiwan Patent Application No. 101118246 dated Oct. 14, 2014, 1 pg.
Taiwan Search Report from Taiwan Patent Application No. 101118247 dated Oct. 15, 2014, 1 pg.
Non-Final Office Action from U.S. Appl. No. 13/306,845 dated Nov. 4, 2014, 12 pgs.
International Search Report and Written Opinion from PCT/US2012/038211 dated Aug. 10, 2012, 8 pgs.
Notification of Grounds for Refusal received in Korean Patent Application No. 10-2013-7029736 dated Feb. 27, 2015, 13 pgs.
Extended European Search Report received in European Patent Application No. 14198969.9 dated Mar. 11, 2015, 5 pgs.
International Search Report and Written Opinion for Singapore Patent Application No. 11201402224W dated Apr. 24, 2015, 24 pgs.
First Office Action for Chinese Patent Application No. 201280024792.5 dated Jun. 3, 2015, 22 pgs.
Notice of Allowance and Fees for Japan Patent Application No. 2014-511502, dated Nov. 5, 2014, 3 pgs.
Final Office Action received in Korean Patent Application No. 10-2013-7029736 dated Sep. 14, 2015, 4 pgs.
Notification of Grounds for Refusal for Korean Patent Application No. 10-2014-7017782, dated Jun. 28, 2015, 7 pgs.
International Search Report and Written Opinion from PCT/US2012/038212 dated Aug. 8, 2012, 20 pgs.
International Preliminary Report on Patentability from PCT/US2012/038212 dated Dec. 5, 2013, 7 pgs.
Bajaj, Rajeev, et al., U.S. Appl. No. 13/113,655, filed May 23, 2011, 48 pgs.

* cited by examiner

POLISHING PAD WITH GROOVED FOUNDATION LAYER AND POLISHING SURFACE LAYER

CROSS-REFERENCE TO RELATED APPLICATIONS

This application is a divisional of U.S. patent application Ser. No. 13/306,849, filed on Nov. 29, 2011, the entire contents of which are hereby incorporated by reference herein.

TECHNICAL FIELD

Embodiments of the present invention are in the field of chemical mechanical polishing (CMP) and, in particular, polishing pads with grooved foundation layers and polishing surface layers.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads with grooved foundation layers and polishing surface layers.

In an embodiment, a polishing pad for polishing a substrate includes a foundation layer having a pattern of grooves disposed therein. A continuous polishing surface layer is attached to the pattern of grooves of the foundation layer.

In another embodiment, a polishing pad for polishing a substrate includes a foundation layer with a surface having a pattern of protrusions disposed thereon. Each protrusion has a top surface and sidewalls. A non-continuous polishing surface layer is attached to the foundation layer and includes discrete portions. Each discrete portion is attached to the top surface of a corresponding one of the protrusions of the foundation layer.

In another embodiment, a method of fabricating a polishing pad for polishing a substrate includes providing a foundation layer with a surface having a pattern of protrusions formed thereon. Each protrusion has a top surface and sidewalls. A polishing surface layer is formed above the foundation layer.

DETAILED DESCRIPTION

Figure 1:
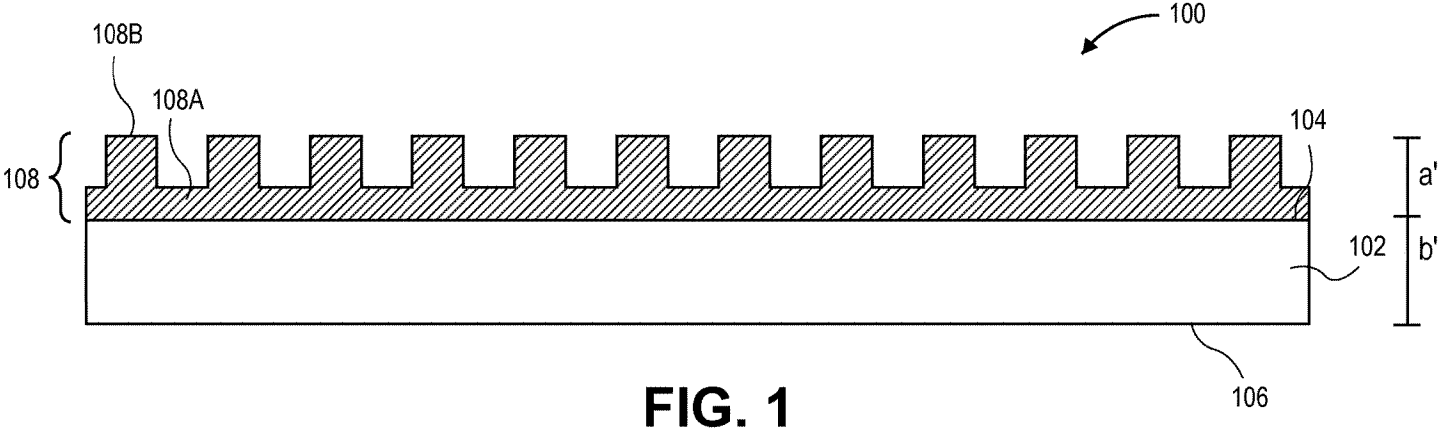
FIG. 1 illustrates a cross-sectional view of a polishing pad with a foundation layer and a polishing surface layer, in accordance with an embodiment of the present invention.

Polishing pads with grooved foundation layers and polishing surface layers are described herein. In the following description, numerous specific details are set forth, such as specific polishing pad compositions and designs, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform CMP of a semiconductor substrate, are not described in detail in order to not unnecessarily obscure embodiments of the present invention. Furthermore, it is to be understood that the various embodiments shown in the figures are illustrative representations and are not necessarily drawn to scale.

Polishing pads for CMP operations may have trade-offs in performance such as a trade-off between across-wafer polishing uniformity versus within die polishing uniformity. For example, hard polishing pads may exhibit good die-level planarization, but poor across-wafer uniformity. They may also scratch a substrate being polished. On the other hand, soft polishing pads may exhibit poor die-level planarization (e.g., they may cause dishing within die), but good wafer-level uniformity. An approach to mitigating the above performance trade-off may be to decouple within-wafer and within-die polishing effects.

Conventional approaches to fabricating and using soft pads may have limitations. For example, casted soft pads may offer low defect characteristics but compromised planarization performance. There may be a need for polishing pads that offer both low defect characteristics yet high planarization performance during polishing operations. Similarly, conventional approaches to fabricating and using hard pads may have limitations. For example, faster gelling speeds possibly inherent in harder urethane formulations may force process compromises that impact pad uniformity and limit formulation options. There may be a need for an approach suitable to produce and implement hard pads that avoid such compromises. Additionally, as noted above, it may be desirable to decouple the properties of the polishing surface of a pad from its bulk properties, such that the properties of each may be separately optimized.

In accordance with an embodiment of the present inventions, polishing pads with bulk or foundation material different from the material of the polishing surface are described herein. Such polishing pads may be fabricated or implemented in approaches suitable to address the above described compromises made for conventional pads. In one embodiment, a composite polishing pad includes a foundation or bulk layer fabricated from a stable, essentially non-compressible, inert material onto which a polishing surface layer is disposed. A harder foundation layer may provide support and strength for pad integrity while a softer polishing surface layer may reduce scratching, enabling decoupling of the material properties of the polishing layer and the remainder of the polishing pad.

In a specific embodiment elaborated in greater detail below, the planarization characteristics of a soft pad is made available by producing a soft polishing surface layer on a stiff backer material or foundation layer, such as a sheet of polycarbonate. For example, in a particular embodiment, a 20 mil (thousandths of an inch) thick polycarbonate sheet was placed on the casting base portion of a pad-making mold and the pad formulation was dispensed directly onto the sheet. The polishing pad was then processed through molding, demolding and curing operations. The result was a uniform pad, with good adhesion between a urethane polishing layer and the polycarbonate support sheet.

In accordance with embodiments of the present invention, approaches to mitigating the above described performance trade-off include the formation of polishing pads having either a soft continuous polishing surface layer or a soft polishing surface layer composed of discrete protrusions bonded with a hard foundation layer. Although the foregoing may be preferred, it is to be understood that reverse arrangements, e.g., a hard polishing surface layer disposed on a soft underlying foundation layer, are also contemplated and described herein.

In a first aspect, a polishing pad is provided with a continuous polishing surface layer. For example, FIG. 1 illustrates a cross-sectional view of a polishing pad with a foundation layer and a polishing surface layer, in accordance with an embodiment of the present invention.

Referring to FIG. 1, a polishing pad 100 is provided for polishing a substrate. The polishing pad 100 includes a foundation layer 102 having a polishing side 104 and a back side 106. The foundation layer 102 is composed of a material having a first hardness. The polishing pad 100 also includes a polishing surface layer 108 bonded with the foundation layer 102. The polishing surface layer 108 is composed of a material having a second hardness. In an embodiment, the polishing surface layer 108 includes a continuous layer portion 108A with a plurality of polishing features 108B protruding there from, as depicted in FIG. 1. It is the continuous layer portion 108A that is bonded with the foundation layer 102. In a preferred, but not limiting, embodiment, the second hardness (the hardness of the polishing surface layer 108) is less than the first hardness (the hardness of the foundation layer 102).

In a second aspect, a polishing pad is provided with a non-continuous polishing surface layer. For example, FIG. 2 illustrates a cross-sectional view of another polishing pad with a foundation layer and a polishing surface layer, in accordance with another embodiment of the present invention.

Figure 2:
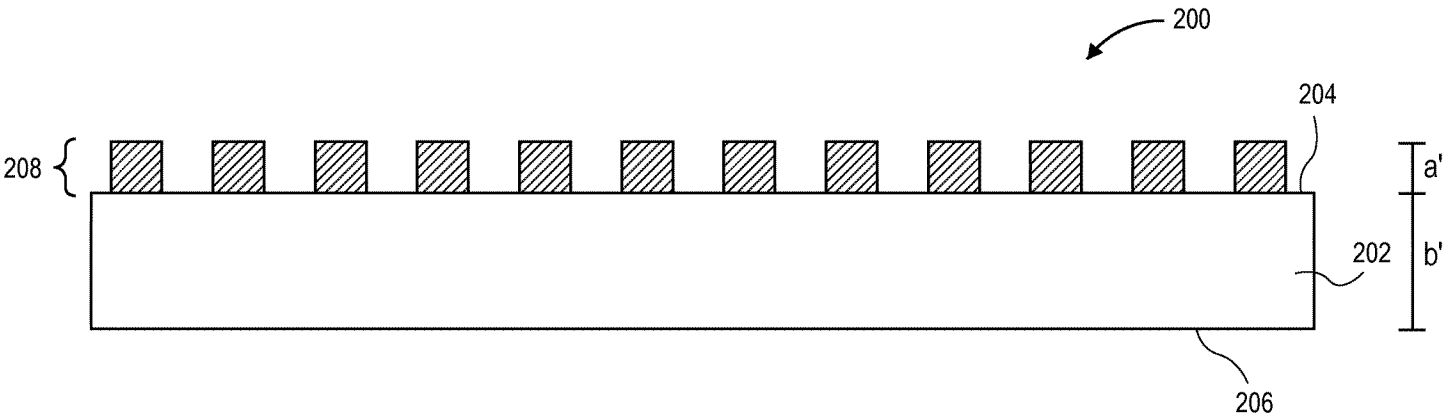
FIG. 2 illustrates a cross-sectional view of another polishing pad with a foundation layer and a polishing surface layer, in accordance with an embodiment of the present invention.

Referring to FIG. 2, a polishing pad 200 is provided for polishing a substrate. The polishing pad 200 includes a foundation layer 202 having a polishing side 204 and a back side 206. The foundation layer 202 is composed of a material having a first hardness. The polishing pad 200 also includes a polishing surface layer 208 bonded with the foundation layer 202. The polishing surface layer 208 is composed of a material having a second hardness. In an embodiment, the polishing surface layer 208 includes only a plurality of discrete protrusions or polishing features protruding there from, as depicted in FIG. 2. It is the discrete polishing protrusions that are bonded with the foundation layer 202. In a preferred, but not limiting, embodiment, the second hardness (the hardness of the polishing surface layer 208 of discrete polishing protrusions) is less than the first hardness (the hardness of the foundation layer 202).

It is noted that the polishing surface layers 108 or 208 are described as being "bonded with" foundation layers 102 or 202, respectively. In a first such embodiment, the polishing surface layers 108 or 208 are bonded directly to foundation layers 102 or 202, respectively. That is, the polishing surface layers 108 or 208 are in direct contact with foundation layers 102 or 202, respectively, as depicted in FIGS. 1 and 2. In one embodiment, then, "bonded directly to" describes direct contact with no intervening layers (such as pressure sensitive adhesive layers) or otherwise glue-like or adhesive films. It may be preferable that the polishing surface layers 108 or 208 are bonded directly to foundation layers 102 or 202, respectively, so that only the polishing surface layer and corresponding foundation layer dictate the polishing performance of a pad composed there of.

In a specific such embodiment, the polishing surface layer 108 or 208 is covalently bonded to the corresponding foundation layer 102 or 202. In an embodiment, the term "covalently bonded" refers to arrangements where atoms from a first material (e.g., the material of a polishing surface layer) are cross-linked or share electrons with atoms from a second material (e.g., the material of a foundation layer) to effect actual chemical bonding. Covalent bonding is distinguished from mechanical bonding, such as bonding through screws, nails, glues, or other adhesives. In another specific embodiment, the polishing surface layer 108 or 208 is not covalently bonded, but is rather only electrostatically bonded, to the corresponding foundation layer 102 or 202. Such electrostatic bonding may involve van der Waals type interactions between the foundation layer and the polishing surface layer.

Other direct bonding may be preferred, in a second such embodiment, the polishing surface layers 108 or 208 are attached to foundation layers 102 or 202, respectively. That is, the polishing surface layers 108 or 208 and corresponding foundation layers 102 or 202, respectively, may include intervening layers (such as pressure sensitive adhesive layers) or otherwise glue-like or adhesive films. Thus, "attached to" describes both direct contact with no intervening layers (such as pressure sensitive adhesive layers) or otherwise glue-like or adhesive films, and also describes situations where such intervening layers are used between a foundation layer and corresponding polishing surface layer.

In either of the above cases, peel resistance may provide an indication of the strength and extent to which a polishing surface layer is bonded with a foundation layer. In an embodiment, the foundation layer 102 or 202 and the corresponding polishing surface layer 108 or 208 have a peel resistance sufficient to withstand a shear force applied during the useful lifetime of the polishing pad.

In an embodiment, a surface roughness is used at the interface of a polishing surface layer and a foundation layer to enhance bond strength of these two portions of a polishing pad. In one such embodiment, the foundation layer 102 or 202 has a surface roughness greater than approximately 1 micrometer Ra (root mean square) where the corresponding polishing surface layer 108 or 208 is bonded directly to the foundation layer (e.g., at interface 104 or 204). In a specific such embodiment, the surface roughness is approximately in the range of 5-10 micrometers Ra (root mean square).

However, in another embodiment, substantial surface roughness is not included and the interface of a polishing surface layer and a foundation layer is particularly smooth. The strength of such a smooth interface may be independent of surface roughness or may not need further strengthening by the inclusion of such surface roughness. In one such embodiment, the foundation layer 102 or 202 has a smooth surface with a surface roughness less than approximately 1 micrometer Ra (root mean square) where the corresponding polishing surface layer 108 or 208 is bonded directly to the foundation layer (e.g., at interface 104 or 204). The decision or need to include or exclude roughness at an interface of a foundation layer and polishing surface layer may depend on the pristine nature of the interface (e.g., exclusion of impurities such as oil films) or on the nature of the materials at the interface. For example, in a particular such embodiment, the polishing surface layer 108 or 208 at a smooth interface is composed of a material formed from polyurethane.

The materials of polishing surface layer 108 or 208 and corresponding foundation layer 102 or 202 may each have defined parameters suitable to provide desired polishing characteristics, either as individual components or collectively for the polishing pad as an entirety. For example, in one such embodiment the polishing surface layer 108 or 208 and corresponding foundation layer 102 or 202 differ in their energy loss factor, or KEL. KEL is parameter for predicting polishing performance. ASTM D4092-90 ("Standard Terminology Relating to Dynamic Mechanical Measurements of Plastics") defines this parameter as the energy per unit volume lost in each deformation cycle. In other words, it is a measure of the area within the stress-strain hysteresis loop. The Energy Loss Factor (KEL) is a function of both tan δ and the elastic storage modulus (E') and may be defined by the following equation: $KEL=\tan\delta*10^{12}/[E'*(1+\tan\delta^2)]$ where E' is in Pascals. The ratio of elastic stress to strain is the storage (or elastic) modulus and the ratio of the viscous stress to strain is the loss (or viscous) modulus. When testing is performed in tension, flex, or compression, E' and E" designate the storage and loss modulus, respectively. The ratio of the loss modulus to the storage modulus is the tangent of the phase angle shift (δ) between the stress and the strain. Thus, $E''/E'=\tan\delta$ and is a measure of the damping ability of the material. In an embodiment, the foundation layer 102 or 202 has an energy loss factor of less than approximately 100 KEL at 1/Pa at 40° C., e.g., of approximately 7. In an embodiment, the polishing surface layer 108 or 208 has an energy loss factor of greater than approximately 1000 KEL at 1/Pa at 40° C., e.g., of approximately 8000. In an embodiment, the foundation layer 102 or 202 has an energy loss factor of less than approximately 100 KEL at 1/Pa at 40° C., the polishing surface layer 108 or 208 has an energy loss factor of greater than approximately 1000 KEL at 1/Pa at 40° C., and the foundation layer 102 of 202 and the corresponding polishing surface layer 108 or 208 together have an energy loss factor of less than approximately 100 KEL at 1/Pa at 40° C.

In another example, the materials of polishing surface layer 108 or 208 and corresponding foundation layer 102 or 202 may each have defined compressibility of elasticity suitable to provide desired polishing characteristics, either as individual components or collectively for the polishing pad as an entirety. In an embodiment, the foundation layer 102 or 202 has a compressibility of less than approximately 1% under a central pressure of 5 PSI. In an embodiment, the polishing surface layer 108 or 208 has a compressibility of greater than approximately 0.1% under a central pressure of 5 PSI. In an embodiment, the polishing surface layer 108 or 208 has a first modulus of elasticity, and the corresponding foundation layer 102 or 202 has a second modulus of elasticity greater than approximately 10 times the first modulus of elasticity, e.g. for a relatively harder polishing surface on a hard foundation layer. In another embodiment, however, the polishing surface layer 108 or 208 has a first modulus of elasticity, and the corresponding foundation layer 102 or 202 has a second modulus of elasticity greater than approximately 100 times the first modulus of elasticity, e.g. for a relatively softer polishing surface on a hard foundation layer.

In another example, the materials of polishing surface layer 108 or 208 and corresponding foundation layer 102 or 202 may each have defined hardness suitable to provide desired polishing characteristics, either as individual components or collectively for the polishing pad as an entirety. In an embodiment, the foundation layer 102 or 202 has a hardness greater than approximately 75 Shore D, e.g., approximately 84-85 Shore D for a polycarbonate foundation layer. In an embodiment, the polishing surface layer 108 or 208 has a hardness less than approximately 70 Shore D and, preferably, less than approximately 60 Shore D. In an embodiment, the foundation layer 102 or 202 has a hardness approximately in the range of 70-90 Shore D, and the corresponding polishing surface layer 108 or 208 has a hardness approximately in the range of 50-60 Shore D, e.g., for a hard polyurethane polishing surface layer. In another embodiment, the foundation layer 102 or 202 has a hardness approximately in the range of 70-90 Shore D, and the corresponding polishing surface layer 108 or 208 has a hardness approximately in the range of 20-50 Shore D, e.g., for a soft polyurethane polishing surface layer.

In another example, the materials of polishing surface layer 108 or 208 and corresponding foundation layer 102 or 202 may each have defined composition suitable to provide desired polishing characteristics, either as individual components or collectively for the polishing pad as an entirety. In an embodiment, the foundation layer 102 or 202 is composed of a polycarbonate material. In one such embodiment, the polycarbonate material is composed of a stack of several discrete layers (sub layers) of polycarbonate or is composed of a single, continuous, layer of polycarbonate. In another embodiment, the foundation layer 102 or 202 is composed of a material such as, but not limited to, an epoxy board material or a metal sheet.

In an embodiment, the polishing surface layer 108 or 208 is a homogeneous polishing surface layer. In one such embodiment, the homogeneous polishing surface layer is composed of a thermoset polyurethane material. For example, in a specific embodiment, the homogeneous body is composed of a thermoset, closed cell polyurethane material. In an embodiment, the term "homogeneous" is used to indicate that the composition of a thermoset, closed cell polyurethane material is consistent throughout the entire composition of the body. For example, in an embodiment, the term "homogeneous" excludes polishing pad bodies composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance. In an embodiment, although the polishing surface layer 108 or 208 is composed of a thermoset material, the corresponding foundation layer 102 or 202 is composed of a thermoplastic material, such as a polycarbonate.

The materials of polishing surface layer 108 or 208 may be molded. The term "molded" may be used to indicate that the polishing surface layer is formed in a formation mold, as described in more detail below in association with FIGS. 5A-5F. In an embodiment, the molded polishing surface layer 108 or 208, upon conditioning and/or polishing, has a polishing surface roughness approximately in the range of 1-5 microns root mean square. In one embodiment, the molded polishing surface layer 108 or 208, upon conditioning and/or polishing, has a polishing surface roughness of approximately 2.35 microns root mean square. In an embodiment, the molded polishing surface layer 108 or 208 has a storage modulus at 25 degrees Celsius approximately in the range of 30-500 megaPascals (MPa). In another embodiment, the molded polishing surface layer 108 or 208 has a storage modulus at 25 degrees Celsius approximately less than 30 megaPascals (MPa).

The materials of polishing surface layer 108 or 208 may include pore-forming features. In an embodiment, the polishing surface layer 108 or 208 has a pore density of closed cell pores approximately in the range of 6%-50% total void volume. In one embodiment, the plurality of closed cell pores is a plurality of porogens. For example, the term "porogen" may be used to indicate micro- or nano-scale spherical or somewhat spherical particles with "hollow" centers. The hollow centers are not filled with solid material, but may rather include a gaseous or liquid core. In one embodiment, the plurality of closed cell pores is composed of pre-expanded and gas-filled EXPANCEL™ distributed throughout (e.g., as an additional component in) a polishing surface layer of a polishing pad. In a specific embodiment, the EXPANCEL™ is filled with pentane. In an embodiment, each of the plurality of closed cell pores has a diameter approximately in the range of 10-100 microns. In an embodiment, the plurality of closed cell pores includes pores that are discrete from one another. This is in contrast to open cell pores which may be connected to one another through tunnels, such as the case for the pores in a common sponge. In one embodiment, each of the closed cell pores includes a physical shell, such as a shell of a porogen, as described above. In another embodiment, however, each of the closed cell pores does not include a physical shell. In an embodiment, the plurality of closed cell pores is distributed essentially evenly throughout a thermoset polyurethane material of a homogeneous polishing surface layer. In an embodiment, although the polishing surface layer 108 or 208 includes pore-forming features, the corresponding foundation layer 102 or 202 does not and is non-porous.

In an embodiment, polishing pads described herein, such as polishing pads 100 or 200, include a polishing surface layer 108 or 208 that is opaque. In one embodiment, the term "opaque" is used to indicate a material that allows approximately 10% or less visible light to pass. In one embodiment, the polishing surface layer 108 or 208 is opaque in most part, or due entirely to, the inclusion of an opacifying particle filler, such as a lubricant, throughout (e.g., as an additional component in) the polishing surface layer 108 or 208. In a specific embodiment, the opacifying particle filler is a material such as, but not limited to boron nitride, cerium fluoride, graphite, graphite fluoride, molybdenum sulfide, niobium sulfide, talc, tantalum sulfide, tungsten disulfide, or Teflon®.

In another example, the materials of polishing surface layer 108 or 208 and corresponding foundation layer 102 or 202 may each have defined dimensions suitable to provide desired polishing characteristics, either as individual components or collectively for the polishing pad as an entirety. In an embodiment, the polishing surface layer 108 or 208 has a thickness (a or a' in FIG. 1 or 2, respectively) approximately in the range of 2-50 mils, and the corresponding foundation layer 102 or 202 has a thickness (b or b' in FIG. 1 or 2, respectively) of greater than approximately 20 mils. In an embodiment, the thickness (b or b') of the foundation layer 102 or 202 is greater than the thickness (a or a') of the polishing surface layer 108 or 208. In an embodiment, the foundation layer 102 or 202 has a thickness (b or b') and hardness relative to the thickness (a or a') and hardness of the corresponding polishing surface layer 108 or 208 sufficient to dictate the bulk polishing characteristics of the corresponding polishing pad 100 or 200. In an embodiment, the foundation layer 102 or 202 is sufficiently thick for the corresponding polishing pad 100 or 200 to provide die-level polishing planarity, but sufficiently thin for the polishing pad to provide wafer-level polishing uniformity.

In an embodiment, polishing pad 100 or 200 further includes a sub pad, e.g., a conventional sub pad as known in the CMP art. The foundation layer 102 or 202 is disposed proximate to the sub pad. In one such embodiment, the sub pad has a hardness less than the hardness of the corresponding foundation layer 102 or 202. In one such embodiment, the sub pad is composed of a material such as, but not limited to, foam, rubber, fiber, felt or a highly porous material. In an embodiment, the foundation layer 102 or 202 has a hardness approximately in the range of 70-90 Shore D, the corresponding polishing surface layer 108 or 208 has a hardness approximately in the range of 20-60 Shore D, and a corresponding sub pad has a hardness less than approximately 90 Shore A. In an embodiment, a polishing pad including a polishing surface layer 108 or 208, the corresponding foundation layer 102 or 202, and a corresponding sub pad provides die-level polishing planarity and wafer-level polishing uniformity for CMP operations.

Although the above embodiments primarily focus on polishing pads with a polishing surface layer softer than a corresponding, underlying, foundation layer, other arrangements are contemplated within the spirit and scope of embodiments of the present invention. For example, in an embodiment, a polishing pad for polishing a substrate includes a foundation layer having a first hardness. A polishing surface layer is bonded with the foundation layer. The polishing surface layer has a second hardness equal to or greater than the first hardness. In one embodiment, the polishing surface layer is directly bonded to, and is covalently bonded to, the foundation layer. In one embodiment, the foundation layer and the polishing surface layer have a peel resistance sufficient to withstand a shear force applied during the useful lifetime of the polishing pad. In one embodiment, the polishing surface layer is composed of a continuous layer portion with plurality of polishing features protruding there from, the continuous layer portion bonded directly to the foundation layer. In one embodiment, the polishing surface layer is composed of a plurality of discrete polishing protrusions bonded directly to the foundation layer.

In another example, in an embodiment, a polishing pad for polishing a substrate includes a foundation layer having an energy loss factor of less than approximately 100 KEL at 1/Pa at 40° C. A polishing surface layer is bonded with the foundation layer. The polishing surface layer has an energy loss factor of greater than approximately 1000 KEL at 1/Pa at 40° C. The foundation layer and the polishing surface layer together have an energy loss factor of less than approximately 100 KEL at 1/Pa at 40° C. In one embodiment, the polishing surface layer is composed of a continuous layer portion with plurality of polishing features protruding there from, the continuous layer portion attached to the foundation layer. In one embodiment, the polishing surface layer is composed of a plurality of discrete polishing protrusions attached to the foundation layer. In one embodiment, the polishing surface layer is composed of a thermoset polyurethane material.

In another example, in an embodiment, a polishing pad for polishing a substrate includes a foundation layer having a first hardness. A polishing surface layer is bonded with the foundation layer. The polishing surface layer has a second hardness less than the first hardness and is composed of a thermoset material. In one embodiment, the polishing surface layer is a homogeneous polishing surface layer. In one embodiment, the thermoset material is polyurethane. In one embodiment, the foundation layer has a hardness approximately in the range of 70-90 Shore D, and the polishing surface layer has a hardness approximately in the range of 50-60 Shore D. In one embodiment, the foundation layer has a hardness approximately in the range of 70-90 Shore D, and the polishing surface layer has a hardness approximately in the range of 20-50 Shore D. In one embodiment, the polishing surface layer is composed of a continuous layer portion with plurality of polishing features protruding there from, the continuous layer portion attached to the foundation layer. In one embodiment, the polishing surface layer is composed of a plurality of discrete polishing protrusions attached to the foundation layer. In one embodiment, the polishing surface layer has a pore density of closed cell pores approximately in the range of 6%-50% total void volume.

In another example, in an embodiment, a polishing pad for polishing a substrate includes a nonporous foundation layer. A polishing surface layer is bonded with the foundation layer. The polishing surface layer has a pore density of closed cell pores. In one embodiment, the pore density of closed cell pores is approximately in the range of 6%-50% total void volume. In one embodiment, the polishing surface layer is composed of a continuous layer portion with plurality of polishing features protruding there from, the continuous layer portion bonded directly to the foundation layer. In one embodiment, the polishing surface layer is composed of a plurality of discrete polishing protrusions bonded directly to the foundation layer.

Figure 3:
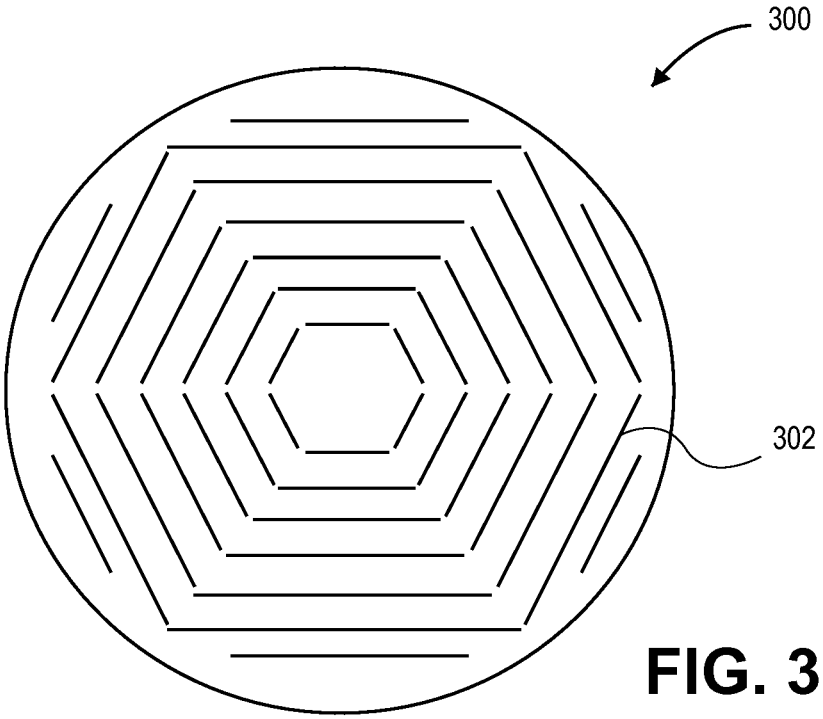
FIG. 3 illustrates a top-down view of a polishing pad with a polishing surface layer including discrete linear segment protrusions, in accordance with an embodiment of the present invention.

In another aspect, the polishing surface layer 108 or 208 may have a pattern suitable for polishing during a CMP operation. In a first general example, some embodiments of the present invention include a plurality of protrusions having a pattern of linear features. In a specific such example, FIG. 3 illustrates a top-down view of a polishing pad 300 with a polishing surface layer including discrete linear segment protrusions 302, in accordance with an embodiment of the present invention. The discrete linear segment protrusions shown are essentially orthogonal to radii of the polishing surface. It is to be understood, however, that embodiments of the present invention may also include discrete linear segments that are not precisely orthogonal to radii of the polishing surface. In such embodiments, the discrete linear segments may form a portion of a, but not a complete, concentric or approximately concentric polygon arrangement. The relative association with the corresponding radius is not precisely 90 degrees but rather, perhaps, a fraction of a degree to a few degrees off of 90 degrees. Nonetheless, such near-orthogonal or approximately orthogonal discrete linear segments are considered to be within the spirit and scope of the present invention.

In a second general example, some embodiments of the present invention include a plurality of protrusions having a pattern of discrete curved features. In a specific such example, discrete arc-shaped protrusions are included. Other specific such embodiments include, but are not limited to, a plurality of partial circumferential protrusions disposed on a substantially circular polishing pad.

In a third general example, some embodiments of the present invention include a plurality of protrusions having a pattern of discrete tiles. In a specific such embodiment, discrete hexagonal tile protrusions are included. Other specific such embodiments include, but are not limited to, pluralities of circular tiles, oval tiles, square tiles, rectangular tiles, or a combination thereof.

Although the above three general examples are defined in terms of protrusions (e.g., the highest points of a patterned polishing surface layer), the polishing surface layers may also or alternatively be defined in terms of grooves (e.g., the lowest points of a patterned polishing surface layer). Individual grooves may be from about 4 to about 100 mils deep at any given point on each groove. In some embodiments, the grooves are about 10 to about 50 mils deep at any given point on each groove. The grooves may be of uniform depth, variable depth, or any combinations thereof. In some embodiments, the grooves are all of uniform depth. For example, the grooves of a groove pattern may all have the same depth. In some embodiments, some of the grooves of a groove pattern may have a certain uniform depth while other grooves of the same pattern may have a different uniform depth. For example, groove depth may increase with increasing distance from the center of the polishing pad. In some embodiments, however, groove depth decreases with increasing distance from the center of the polishing pad. In some embodiments, grooves of uniform depth alternate with grooves of variable depth.

Individual grooves may be from about 2 to about 100 mils wide at any given point on each groove. In some embodiments, the grooves are about 15 to about 50 mils wide at any given point on each groove. The grooves may be of uniform width, variable width, or any combinations thereof. In some embodiments, the grooves of a groove pattern are all of uniform width. In some embodiments, however, some of the grooves of a groove pattern have a certain uniform width, while other grooves of the same pattern have a different uniform width. In some embodiments, groove width increases with increasing distance from the center of the polishing pad. In some embodiments, groove width decreases with increasing distance from the center of the polishing pad. In some embodiments, grooves of uniform width alternate with grooves of variable width.

In accordance with the previously described depth and width dimensions, individual grooves may be of uniform volume, variable volume, or any combinations thereof. In some embodiments, the grooves are all of uniform volume. In some embodiments, however, groove volume increases with increasing distance from the center of the polishing pad. In some other embodiments, groove volume decreases with increasing distance from the center of the polishing pad. In some embodiments, grooves of uniform volume alternate with grooves of variable volume.

Grooves of the groove patterns described herein may have a pitch from about 30 to about 1000 mils. In some embodiments, the grooves have a pitch of about 125 mils. For a circular polishing pad, groove pitch is measured along the radius of the circular polishing pad. In CMP belts, groove pitch is measured from the center of the CMP belt to an edge of the CMP belt. The grooves may be of uniform pitch, variable pitch, or in any combinations thereof. In some embodiments, the grooves are all of uniform pitch. In some embodiments, however, groove pitch increases with increasing distance from the center of the polishing pad. In some other embodiments, groove pitch decreases with increasing distance from the center of the polishing pad. In some embodiments, the pitch of the grooves in one sector varies with increasing distance from the center of the polishing pad while the pitch of the grooves in an adjacent sector remains uniform. In some embodiments, the pitch of the grooves in one sector increases with increasing distance from the center of the polishing pad while the pitch of the grooves in an adjacent sector increases at a different rate. In some embodiments, the pitch of the grooves in one sector increases with increasing distance from the center of the polishing pad while the pitch of the grooves in an adjacent sector decreases with increasing distance from the center of the polishing pad. In some embodiments, grooves of uniform pitch alternate with grooves of variable pitch. In some embodiments, sectors of grooves of uniform pitch alternate with sectors of grooves of variable pitch.

In another aspect, a polishing pad with a polishing surface layer and corresponding foundation layer further includes a detection region for use with, e.g., an eddy current detection system. For example, FIG. 4 illustrates a top-down plan view of a polishing pad with a polishing surface layer having an aperture and/or an indication region, in accordance with an embodiment of the present invention.

Figure 4:
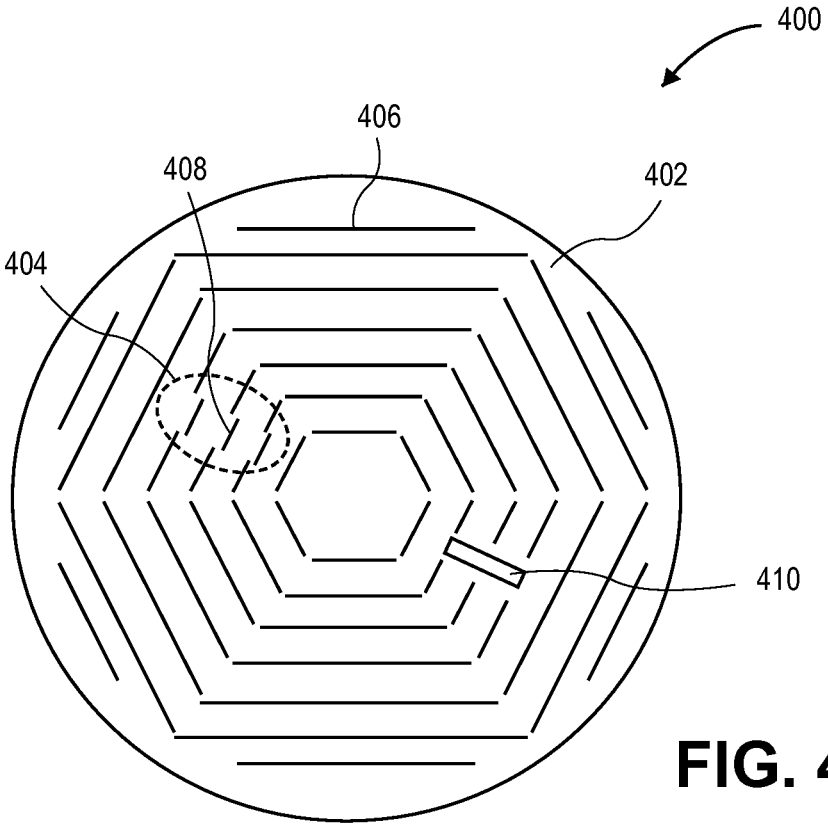
FIG. 4 illustrates a top-down plan view of a polishing pad with a polishing surface layer having an aperture and/or an indication region, in accordance with an embodiment of the present invention.

Referring to FIG. 4, the polishing surface layer 402 of polishing pad 400 includes an indication region 404 indicating the location of a detection region disposed in the back surface of the polishing pad 400, e.g., in the back surface of a corresponding foundation layer. In one embodiment, the indication region 404 interrupts a pattern of protrusions 406 with a second pattern of protrusions 408, as depicted in FIG. 4. Examples of suitable detection regions, such as eddy current detection regions, are described in U.S. patent application Ser. No. 12/895,465 filed on Sep. 30, 2010, assigned to NexPlanar Corporation.

In another aspect, a polishing pad with a polishing surface layer and corresponding foundation layer further includes an aperture disposed in the polishing pad. For example, referring again to FIG. 4, an aperture 410 is disposed in the polishing surface layer 402 of polishing pad 400. As depicted in FIG. 4, the aperture 410 interrupts the pattern of protrusions 406. In an embodiment, the aperture 410 is disposed in the polishing pad 400, through the polishing surface layer 402 and a corresponding foundation layer. An adhesive sheet is disposed on a back surface of the foundation layer but not in the aperture. The adhesive sheet provides an impermeable seal for the aperture 410 at the back surface of the foundation layer. Examples of apertures are described in U.S. patent application Ser. No. 13/184,395 filed on Jul. 15, 2011, assigned to NexPlanar Corporation.

In another aspect, polishing pads with foundation layers and corresponding polishing surface layers may be fabricated in a molding process. For example, such multi-layer (e.g., surface polishing layer plus underlying foundation layer) polishing pads as those described above may be fabricated with a molding process to facilitate direct bonding between a surface polishing layer and an underlying foundation layer. FIGS. 5A-5F illustrate cross-sectional views of operations used in the fabrication of a polishing pad with a foundation layer and a polishing surface layer, in accordance with an embodiment of the present invention.

Figure 5A:
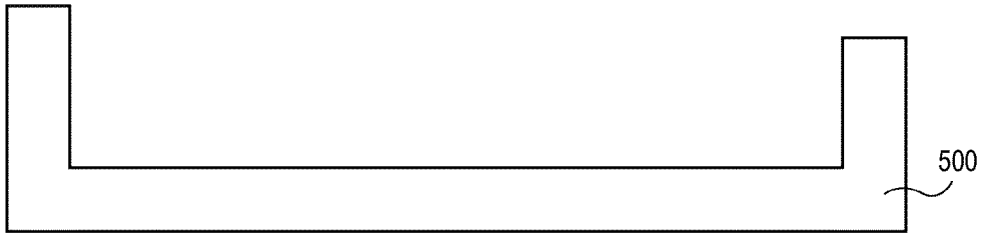
FIGS. 5A-5F illustrate cross-sectional views of operations used in the fabrication of a polishing pad with a foundation layer and a polishing surface layer, in accordance with an embodiment of the present invention.
Figure 5B:
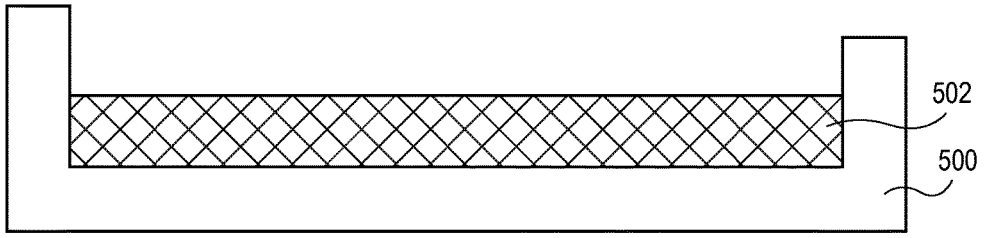
Figure 5C:
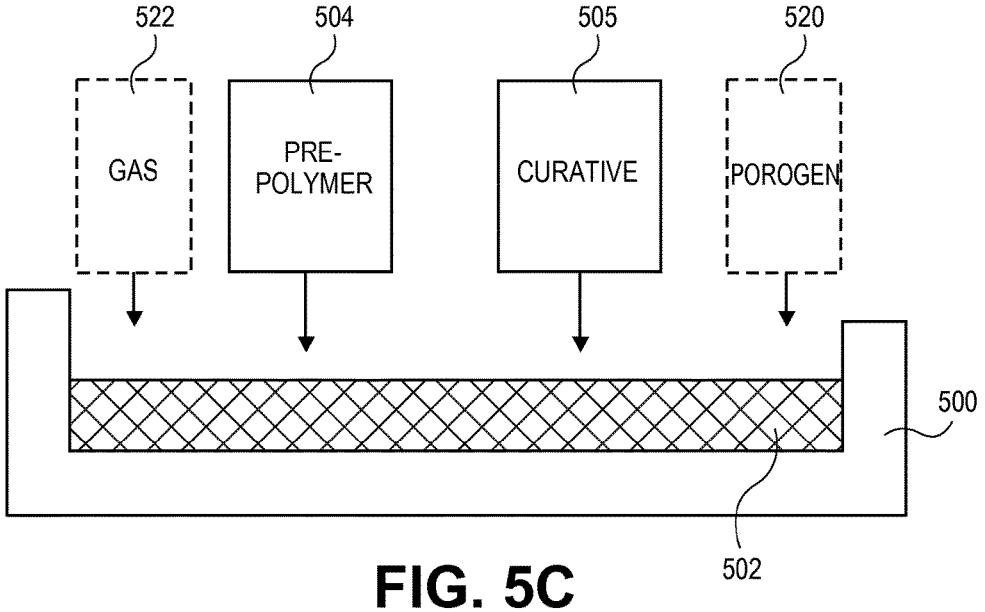

Referring to FIG. 5A, a formation mold 500 is provided. A foundation layer 502 is then provided in the formation mold 500. The foundation layer 502 may be composed of a material or have properties similar or the same as the materials and properties described above for foundation layers 102 and 202. In an embodiment, the material of foundation layer 502 is in a completed form, e.g., fully cured, when provided in the formation mold 502. For example, in an embodiment, the foundation layer 502 is cut from a larger sheet of the same material and sized for formation mold 500. In one embodiment, the foundation layer 502 is placed in a base of the formation mold 500, as depicted in FIG. 5B. In an embodiment, providing the foundation layer 502 in the formation mold 500 includes first roughening a surface of the foundation layer 502, e.g., roughening the surface upon which a polishing surface layer will ultimately be formed. In one such embodiment, the roughening is performed by a technique such as, but not limited to, plasma treatment, mechanical treatment, or chemical treatment.

Figure 5D:
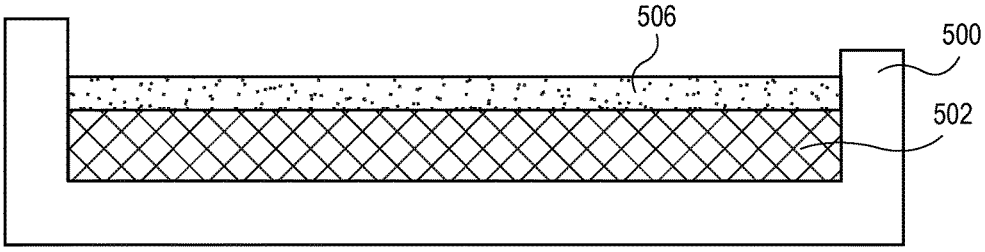

A mixture is formed from mixing a set of polymerizable materials. For example, referring to both FIGS. 5C and 5D a pre-polymer 504 and a curative 505 are mixed to form a mixture 506 in the formation mold 500. In an embodiment, forming the mixture 506 includes providing the mixture 506 in the base of the formation mold 500, on the foundation layer 502, as depicted in FIG. 5D. In an embodiment, mixing the pre-polymer 504 and the curative 505 includes mixing an isocyanate and an aromatic diamine compound, respectively. In one embodiment, the mixing further includes adding an opacifying particle filler to the pre-polymer 504 and the curative 505 to ultimately provide an opaque molded polishing surface layer of a polishing pad. In a specific embodiment, the opacifying particle filler is a material such as, but not limited to boron nitride, cerium fluoride, graphite, graphite fluoride, molybdenum sulfide, niobium sulfide, talc, tantalum sulfide, tungsten disulfide, or Teflon.

In an embodiment, the mixture 506 is used to ultimately form a molded polishing surface layer composed of a thermoset, closed cell polyurethane material. In one embodiment, the mixture 506 is used to ultimately form a hard polishing surface layer and only a single type of curative is used. In another embodiment, the mixture 506 is used to ultimately form a soft polishing surface layer and a combination of a primary and a secondary curative is used. For example, in a specific embodiment, the pre-polymer includes a polyurethane precursor, the primary curative includes an aromatic diamine compound, and the secondary curative includes a compound having an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, the pre-polymer, a primary curative, and a secondary curative have an approximate molar ratio of 100 parts pre-polymer, 85 parts primary curative, and 15 parts secondary curative. It is to be understood that variations of the ratio may be used to provide a molded polishing surface layer with varying hardness values, or based on the specific nature of the pre-polymer and the first and second curatives. In an embodiment, mixing the pre-polymer and any curatives to form the mixture 506 includes degassing the mixture 506.

Figure 5E:
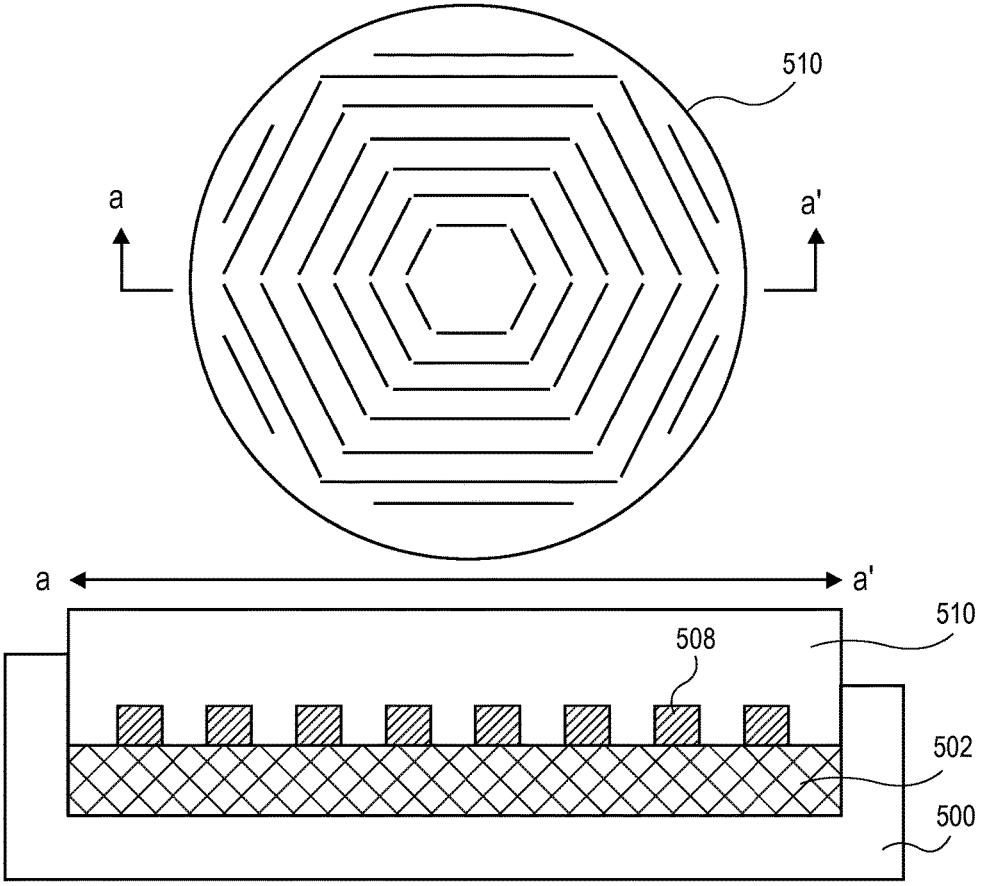

Referring to FIG. 5E, a lid 510 of the formation mold 500 is placed into the mixture 506. A top-down plan view of lid 510 is shown on top, while a cross-section along the a-a' axis is shown below in FIG. 5E. The lid 510 has disposed thereon a pattern of protrusions, such as a pattern of protrusions corresponding to the pattern of grooves or protrusions described in association with FIG. 3, as depicted in FIG. 5E.

It is to be understood that embodiments described herein involving lowering the lid 510 of a formation mold 500 need only achieve a bringing together of the lid 510 and a base of the formation mold 500. That is, in some embodiments, a base of a formation mold 500 is raised toward a lid 510 of a formation mold, while in other embodiments a lid 510 of a formation mold 500 is lowered toward a base of the formation mold 500 at the same time as the base is raised toward the lid 510.

With the lid 510 placed in the mixture 506, the mixture 506 is at least partially cured to form a polishing surface layer 508 disposed on the foundation layer 502. The pattern of protrusions of the lid 510 is used to stamp a pattern of grooves from the mixture 506 in the formation mold 500. The mixture 506 may be heated under pressure (e.g., with the lid 510 in place) to provide the molded polishing surface layer 508. In an embodiment, heating in the formation mold 500 includes at least partially curing in the presence of lid 510, which encloses the mixture 506 in formation mold 500, at a temperature approximately in the range of 200-260 degrees Fahrenheit and a pressure approximately in the range of 2-12 pounds per square inch.

In an embodiment, at least partially curing the mixture 506 includes heating the base of the formation mold 500. In an embodiment, at least partially curing the mixture 506 includes heating both the mixture 506 and the foundation layer 502. This approach may alleviate compression stress that may otherwise result upon cooling of a molded polishing surface layer if the foundation layer 502 is not heated. In an embodiment, at least partially curing the mixture 506 forms the molded homogeneous polishing surface layer 508 covalently bonded with the foundation layer 502.

Figure 5F:
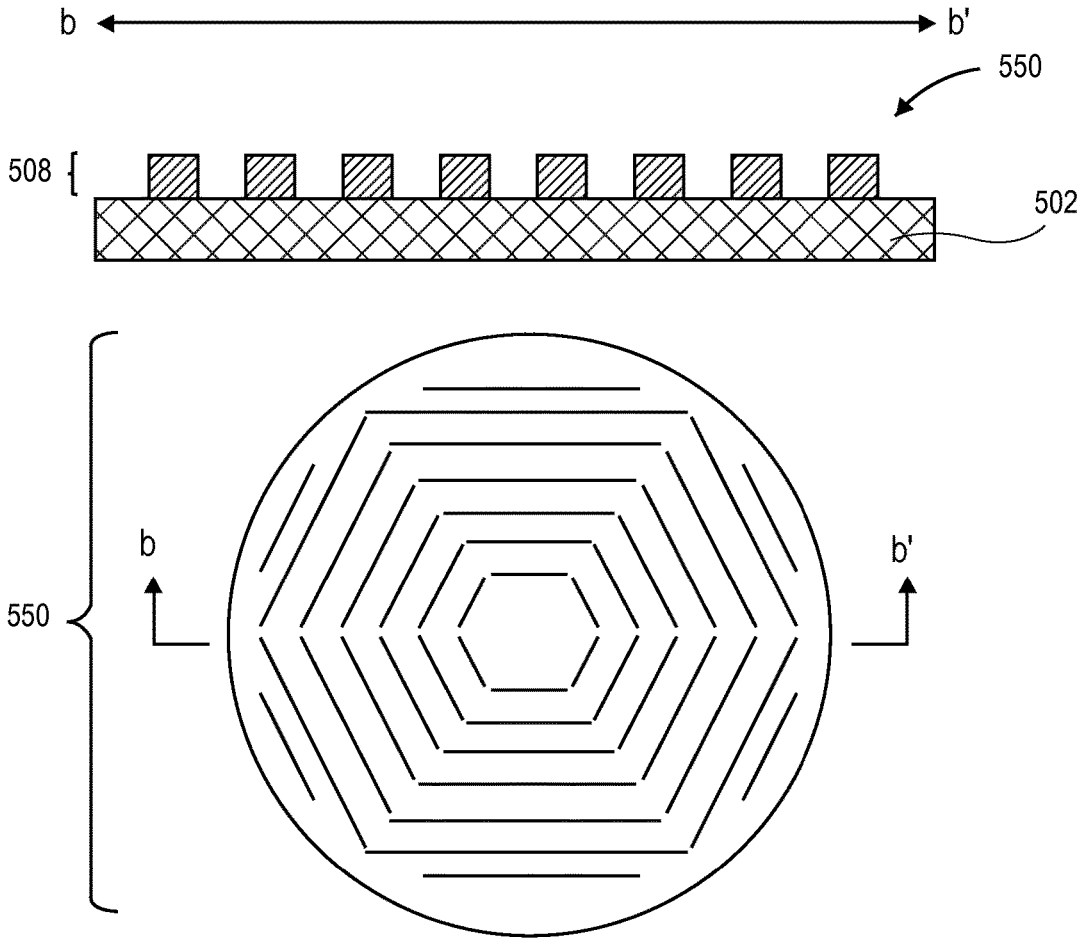

Referring to FIG. 5F, a polishing pad 550 is provided upon removal of the coupled foundation layer 502 and molded polishing surface layer 508 from the formation mold 500. The polishing surface layer 508 has a pattern of grooves corresponding to the pattern of protrusions of the lid 510. A top-down plan view of the polishing pad 550 is shown below, while a cross-section taken along the b-b' axis is shown above in FIG. 5F. In an embodiment, as shown in FIG. 5F, the polishing surface layer 508 is formed from discrete protrusions (to form the groove pattern), similar or the same as the polishing surface layer 208 described in association with FIG. 2. However, in another embodiment, the polishing surface layer 508 is a continuous layer with protrusions formed there from, similar or the same as the polishing surface layer 108 described in association with FIG. 1. In either case, the polishing surface layer 508 may be composed of a material or have properties similar or the same as the materials and properties described above for polishing surface layers 108 and 208.

By including a foundation layer in the molding process, efficiency may be built into the molding process with respect to timing of demolding a fabricated pad from the formation mold. For example, in an embodiment, removal of the coupled foundation layer 502 and molded polishing surface layer 508 from the formation mold 500 (e.g., removal of polishing pad 550) is performed when the extent of curing is sufficient to maintain geometry of the molded homogeneous polishing surface layer 508 but insufficient for the molded homogeneous polishing surface layer 508 to withstand mechanical stress. That is, the removal is performed prior to removal of a solo molded homogeneous polishing surface layer could otherwise be performed in the absence of a foundation layer. In one such embodiment, the foundation layer 502 having the molded homogeneous polishing surface layer 508 attached thereto is removed from the base of the formation mold 500 less than approximately 4 minutes after coupling the pattern of grooves of the formation mold of lid 510 with the mixture 506. Such timing may reflect an approximately 3-fold reduction in time for the molding process, enabling greater throughput in a given individual mold. In an embodiment, removal of the coupled foundation layer 502 and molded polishing surface layer 508 from the formation mold 500 is performed immediately after the material of the molded homogeneous polishing surface layer 508 gels.

In addition to adding backing support, the foundation layer may additionally be sized larger than the polishing surface layer 508 to further enable an earlier demolding time. For example, in one embodiment, the foundation layer 502 extends beyond the molded homogeneous polishing surface layer 508, and removing the foundation layer 502 having the molded homogeneous polishing surface layer 508 formed thereon from the base of the formation mold 500 includes taking hold of the foundation layer 502 but not the molded homogeneous polishing surface layer 508.

It is noted that further curing of the polishing surface layer 508 through heating may be desirable and may be performed by placing the polishing pad 550 in an oven and heating. Thus, in one embodiment, curing the mixture 506 includes first partially curing in the formation mold 500 and then further curing in an oven. Either way, a polishing pad 550 is ultimately provided, wherein a molded polishing surface layer 508 is formed on a foundation layer 502. In an embodiment, the molded polishing surface layer 508 is composed of a thermoset polyurethane material with a plurality of closed cell pores disposed in the thermoset polyurethane material.

By including a foundation layer in the molding process, further processing of a fabricated pad there from may be reduced or eliminated. For example, conventional molding may require subsequent back-side cutting of the body of a polishing pad. However, in an embodiment, a polishing pad (e.g., polishing pad 550) including the foundation layer 502 having the molded homogeneous polishing surface layer 508 formed thereon is suitable for performing a polishing process without performing a backside cut of the foundation layer 502, or of the polishing pad 550 in general.

By including a foundation layer in the molding process, recycling or reuse of materials may be made possible. For example, in an embodiment, the molded homogeneous polishing surface layer 508 is removed from the foundation layer 502, and a second homogeneous polishing surface layer is formed on the foundation layer. Such a reuse process of the foundation layer 502 may be performed after the life of the polishing surface layer and, thus, the life of the polishing pad is determined to have terminated in a CMP facility. In another such embodiment, providing the foundation layer 502 in the formation mold 500 includes first removing a previously formed polishing surface layer from the foundation layer 502.

In an embodiment, referring again to FIG. 5C, the mixing further includes adding a plurality of porogens 520 to the pre-polymer 504 and the curative 505 to provide closed cell pores in the ultimately formed polishing surface layer 508 of the polishing pad 550. Thus, in one embodiment, each closed cell pore has a physical shell. In another embodiment, referring again to FIG. 5C, the mixing further includes injecting a gas 522 into to the pre-polymer 504 and the curative 505, or into a product formed there from, to provide closed cell pores in the ultimately formed polishing surface layer 508 of the polishing pad 550. Thus, in one embodiment, each closed cell pore has no physical shell. In a combination embodiment, the mixing further includes adding a plurality of porogens 520 to the pre-polymer 504 and the curative 505 to provide a first portion of closed cell pores each having a physical shell, and further injecting a gas 522 into the pre-polymer 504 and the curative 505, or into a product formed there from, to provide a second portion of closed cell pores each having no physical shell. In yet another embodiment, the pre-polymer 504 is an isocyanate and the mixing further includes adding water ($H_2O$) to the pre-polymer 504 and the curative 505 to provide closed cell pores each having no physical shell.

Thus, protrusion patterns contemplated in embodiments of the present invention may be formed in-situ. For example, as described above, a compression-molding process may be used to form polishing pads with a foundation layer having a molded polishing layer with protrusions disposed thereon. By using a molding process, highly uniform protrusion dimensions within-pad may be achieved. Furthermore, extremely reproducible protrusion dimensions along with very smooth, clean protrusion surfaces may be produced. Other advantages may include reduced defects and micro-scratches and a greater usable protrusion depth.

Also, since the fabricated protrusions of the polishing surface layer are formed during the molding, the positioning of the resulting pad during formation of a pad in a mold can be determined after removal of the pad from the mold. That is, such an polishing surface layer may be designed (e.g., with clocking marks) to provide traceability back to the molding process. Thus, in one embodiment, the polishing surface layer of a polishing pad is a molded polishing surface layer, and an feature included therein indicates a location of a region in a mold used for forming a resulting polishing pad.

In another aspect, a polishing pad is provided with a topographically patterned foundation layer bonded with a corresponding polishing surface layer. For example, FIG. 6 illustrates a cross-sectional view of a polishing pad with a grooved foundation layer and a polishing surface layer, in accordance with an embodiment of the present invention.

Figure 6:
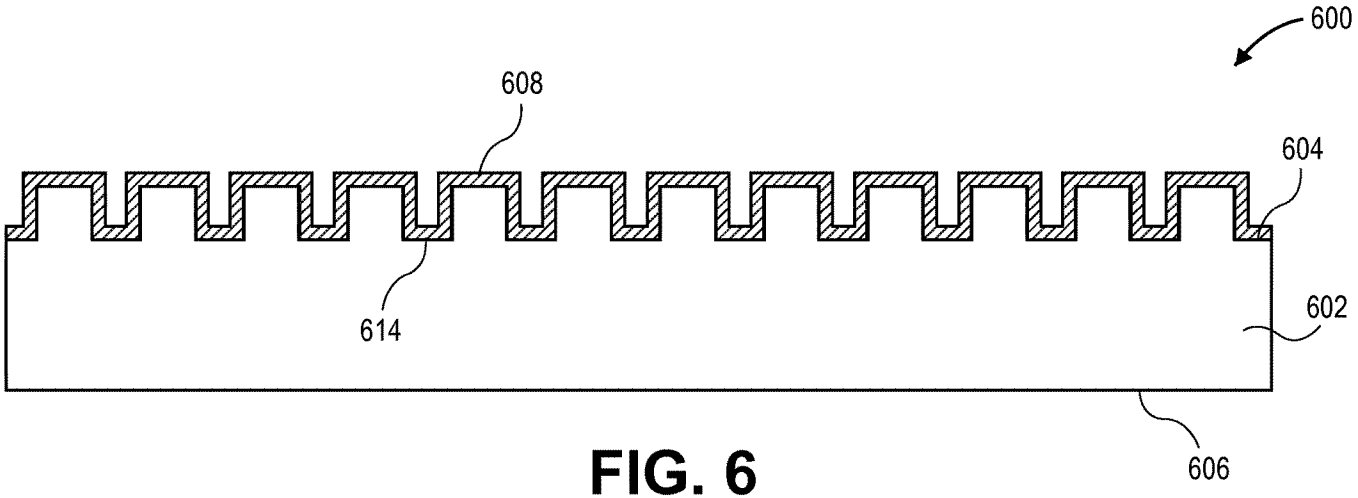
FIG. 6 illustrates a cross-sectional view of a polishing pad with a grooved foundation layer and a polishing surface layer, in accordance with an embodiment of the present invention.

Referring to FIG. 6, a polishing pad 600 is provided for polishing a substrate. The polishing pad 600 includes a grooved foundation layer 602 having a polishing side 604 and a back side 606. The polishing side 604 of the grooved foundation layer 602 has a pattern of grooves 614 (and corresponding protrusions) disposed therein. A continuous polishing surface layer 608 is attached to the grooved foundation layer 602, conformal with the pattern of grooves 614. In a preferred, but not limiting, embodiment, the hardness of the polishing surface layer 608 is less than the hardness of the grooved foundation layer 602. In an embodiment, the grooved foundation layer 602 is formed by molding a pattern of grooves into the foundation layer during fabrication thereof, or etching a pattern of grooves into a topographically smooth staring layer.

Figure 7:
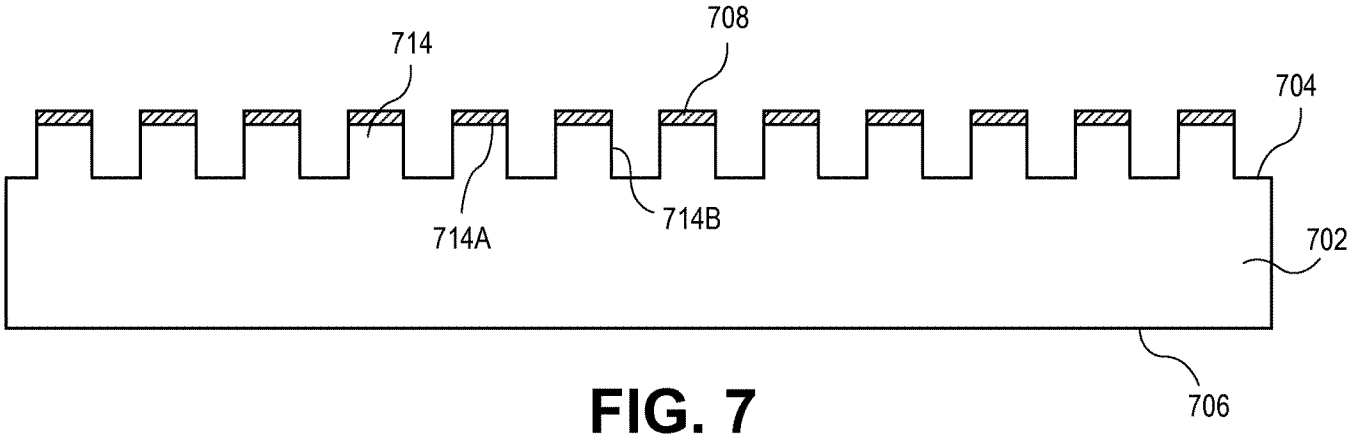
FIG. 7 illustrates a cross-sectional view of another polishing pad with a grooved foundation layer and a polishing surface layer, in accordance with an embodiment of the present invention.

In another example, FIG. 7 illustrates a cross-sectional view of another polishing pad with a grooved foundation layer and a polishing surface layer, in accordance with an embodiment of the present invention.

Referring to FIG. 7, a polishing pad 700 is provided for polishing a substrate. The polishing pad 700 includes a grooved foundation layer 702 having a polishing side 704 and a back side 706. The polishing side 704 of the grooved foundation layer 702 has a pattern of protrusions 714 (and corresponding grooves) disposed thereon. Each protrusion 714 has a top surface 714A and sidewalls 714B. A non-continuous polishing surface layer 708 is attached to the grooved foundation layer 702. The non-continuous polishing surface layer 708 is composed of discrete portions, each discrete portion attached to the top surface 714A of a corresponding one of the protrusions 714 of the grooved foundation layer 702. In a preferred, but not limiting, embodiment, the hardness of the non-continuous polishing surface layer 708 is less than the hardness of the grooved foundation layer 702.

It is to be understood that, while remaining discrete, the material of the non-continuous polishing surface layer 708 may not be entirely limited to the top surfaces 714A of the protrusions 714. Depending on the approach used to apply the non-continuous polishing surface layer 708, other regions of each of the protrusions 714 may be inadvertently or intentionally covered with the non-continuous polishing surface layer 708. For example, in an embodiment (not shown), each discrete portion of the non-continuous polishing surface layer 708 is further attached to a portion of the sidewalls 714B of the corresponding protrusions 714 of the foundation layer 702.

It is to be understood that the polishing surface layer 608 or 708 may be composed of a material or have properties similar or the same as the materials and properties described above for polishing surface layers 108 and 208. Likewise, the foundation layer 602 or 702 may be composed of a material or have properties similar or the same as the materials and properties described above for foundation layers 102 and 202. Such materials and/or properties may include, but are not limited to, bonding type between the foundation layer 602 or 702 and the corresponding polishing surface layer 608 or 708, energy loss factor (KEL), compressibility, hardness, composition, the inclusion of a detection region, the inclusion of an aperture, or the inclusion of a sub pad.

Dimensions for the polishing pads 600 or 700 may be selected based on polishing performance characteristics. In an embodiment, the continuous polishing surface layer 608 has a thickness approximately in the range of 2-50 mils, and the foundation layer 602 has a thickness of greater than approximately 20 mils. In an embodiment, the non-continuous polishing surface layer 708 has a thickness approximately in the range of 2-50 mils, and the foundation layer 702 has a thickness of greater than approximately 20 mils. In an embodiment, the foundation layer 602 or 702 has a thickness and hardness relative to the thickness and hardness of the continuous polishing surface layer 608 or the non-continuous polishing surface layer 708, respectively, sufficient to dictate the bulk polishing characteristics of the corresponding polishing pad 600 or 700. In an embodiment, the foundation layer 602 or 702 is sufficiently thick for the corresponding polishing pad 600 or 700 to provide die-level polishing planarity, but sufficiently thin for the polishing pad 600 or 700 to provide wafer-level polishing uniformity. In an embodiment, for very thin polishing surface layers, the hardness measurement corresponds to the bulk or foundation layer hardness measurement.

In an embodiment, more than one continuous surface layer with an uppermost continuous polishing surface layer (such as continuous polishing surface layer 608) may be used. In another embodiment, more than one non-continuous surface layer with an uppermost non-continuous polishing surface layer (such as non-continuous polishing surface layer 808) may be used. In another embodiment, a combination of a plurality of continuous and non-continuous surface layers may be used. Such combinations may be combinations of homogeneous or non-homogeneous materials.

Referring as an example to the polishing pads 600 and 700, in an embodiment, a method of fabricating a polishing pad for polishing a substrate includes providing a foundation layer with a surface having a pattern of protrusions formed thereon. Each protrusion has a top surface and sidewalls. A polishing surface layer is then formed above the foundation layer. In one such embodiment, forming the polishing surface layer includes forming a continuous polishing surface layer attached to the foundation layer, conformal with the pattern of protrusions, such as depicted in FIG. 6. In another such embodiment, forming the polishing surface layer includes forming a non-continuous polishing surface layer attached to the foundation layer and having discrete portions. Each discrete portion is attached to the top surface of a corresponding one of the protrusions of the foundation layer, such as depicted in FIG. 7. In an embodiment, forming the polishing surface layer (continuous or non-continuous) includes forming the polishing surface layer directly on the foundation layer.

In an embodiment, forming the polishing surface layer includes using a technique such as, but not limited to, rolling on the polishing surface layer, spraying on the polishing surface layer, double molding the polishing surface layer with the foundation layer, printing the polishing surface layer, or stamping on the polishing surface layer. Polishing pads made in such a manner may be amenable to reuse. For example, in one embodiment, at end of life of the polishing pad, the polishing surface layer is removed from the foundation layer. A second polishing surface layer is then formed above the foundation layer. In an embodiment, providing the foundation layer includes first removing a previously formed polishing surface layer from the foundation layer.

In an embodiment, polishing pads described herein, such as polishing pads 100, 200, 300, 400, 600 or 700, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities. In an embodiment, a polishing pad has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters.

Polishing pads described herein may be suitable for use with a variety of chemical mechanical polishing apparatuses. As an example, FIG. 8 illustrates an isometric side-on view of a polishing apparatus compatible with a polishing pad with a foundation layer and a polishing surface layer, in accordance with an embodiment of the present invention.

Figure 8:
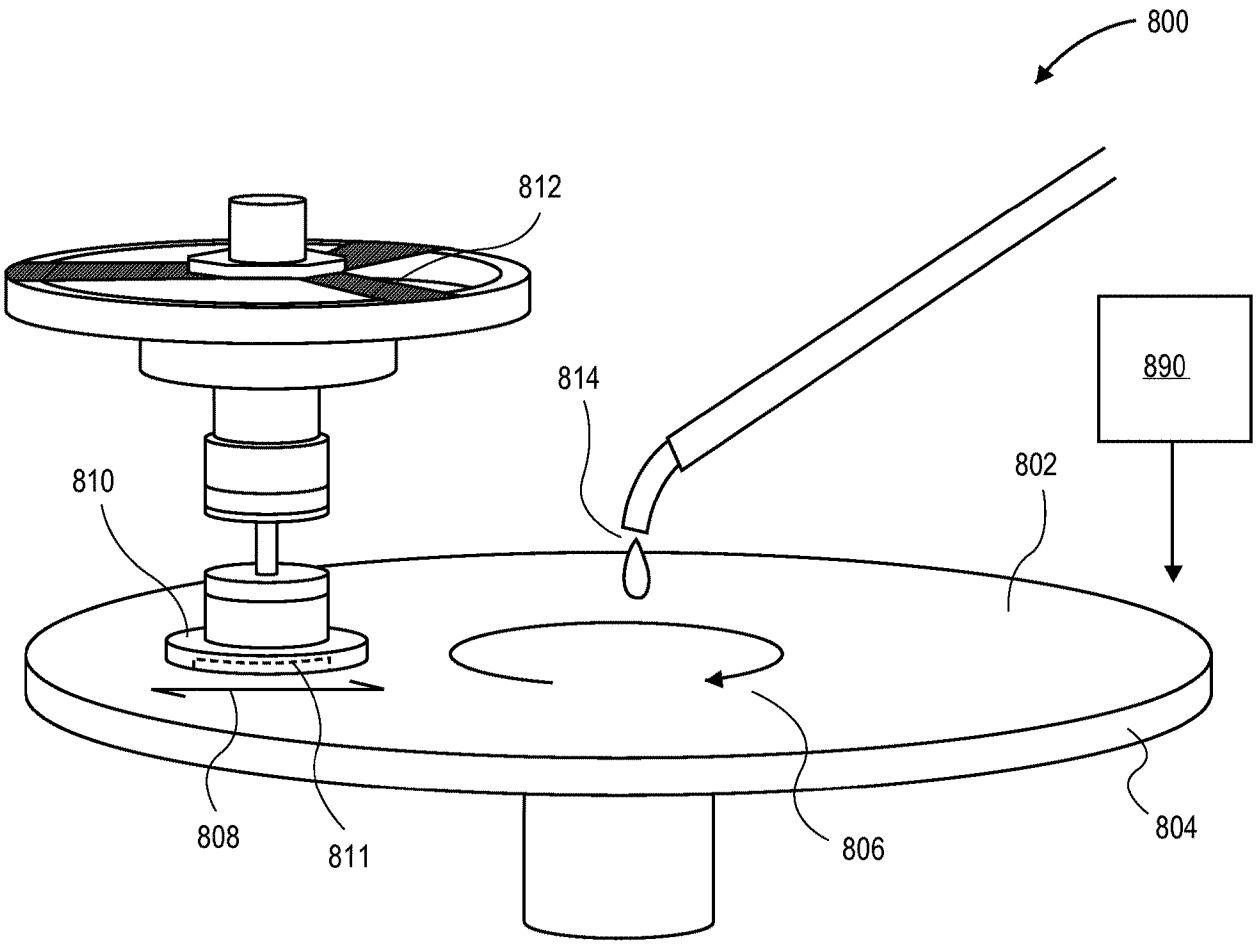
FIG. 8 illustrates an isometric side-on view of a polishing apparatus compatible with a polishing pad with a foundation layer and a polishing surface layer, in accordance with an embodiment of the present invention.

Referring to FIG. 8, a polishing apparatus 800 includes a platen 804. The top surface 802 of platen 804 may be used to support a polishing pad with a foundation layer and a polishing surface layer. Platen 804 may be configured to provide spindle rotation 806 and slider oscillation 808. A sample carrier 810 is used to hold, e.g., a semiconductor wafer 811 in place during polishing of the semiconductor wafer with a polishing pad. Sample carrier 810 is further supported by a suspension mechanism 812. A slurry feed 814 is included for providing slurry to a surface of a polishing pad prior to and during polishing of the semiconductor wafer. A conditioning unit 890 may also be included and, in one embodiment, includes a diamond tip for conditioning a polishing pad.

Thus, polishing pads with grooved foundation layers and polishing surface layers have been disclosed. In accordance with an embodiment of the present invention, a polishing pad for polishing a substrate includes a foundation layer having a pattern of grooves disposed therein. A continuous polishing surface layer is attached to the pattern of grooves of the foundation layer. In one embodiment, the continuous polishing surface layer is bonded directly to the foundation layer. In accordance with another embodiment of the present invention, a polishing pad for polishing a substrate includes a foundation layer with a surface having a pattern of protrusions disposed thereon. Each protrusion has a top surface and sidewalls. A non-continuous polishing surface layer is attached to the foundation layer and includes discrete portions. Each discrete portion is attached to the top surface of a corresponding one of the protrusions of the foundation layer. In one embodiment, each discrete portion is further attached to a portion of the sidewalls of the corresponding one of the protrusions of the foundation layer. In one embodiment, the non-continuous polishing surface layer is bonded directly to the foundation layer.

What is claimed is:

1. A polishing pad for polishing a substrate, the polishing pad comprising:

a foundation layer with a surface having a pattern of protrusions disposed thereon, each protrusion having a top surface and sidewalls; and a non-continuous polishing surface layer attached to the foundation layer and comprising discrete portions, each discrete portion attached to the top surface of a corresponding one of the protrusions of the foundation layer, wherein the foundation layer has an energy loss factor of less than approximately 100 KEL at 1/Pa at 40° C., wherein the non-continuous polishing surface layer has an energy loss factor of greater than approximately 1000 KEL at 1/Pa at 40° C., and wherein the foundation layer and the non-continuous polishing surface layer together have an energy loss factor of less than approximately 100 KEL at 1/Pa at 40° C.

2. The polishing pad of claim 1, wherein each discrete portion is further attached to a portion of the sidewalls of the corresponding one of the protrusions of the foundation layer.

3. The polishing pad of claim 1, wherein the non-continuous polishing surface layer is bonded directly to the foundation layer.

4. The polishing pad of claim 3, wherein the non-continuous polishing surface layer is covalently bonded to the foundation layer.

5. The polishing pad of claim 1, wherein the foundation layer has a compressibility of less than approximately 1% under a central pressure of 5 PSI.

6. The polishing pad of claim 1, wherein the foundation layer has a hardness greater than approximately 75 Shore D.

7. The polishing pad of claim 1, wherein the foundation layer comprises a polycarbonate material.

8. The polishing pad of claim 1, wherein the foundation layer comprises a material selected from the group consisting of an epoxy board material and a metal sheet.

9. The polishing pad of claim 1, wherein the non-continuous polishing surface layer has a compressibility of greater than approximately 0.1% under a central pressure of 5 PSI.

10. The polishing pad of claim 1, wherein the non-continuous polishing surface layer has a hardness less than approximately 70 Shore D.

11. The polishing pad of claim 1, wherein the non-continuous polishing surface layer is a homogeneous polishing surface layer.

12. The polishing pad of claim 11, wherein the homogeneous polishing surface layer comprises a thermoset polyurethane material.

13. The polishing pad of claim 1, wherein the non-continuous polishing surface layer has a pore density of closed cell pores approximately in the range of 6%-50% total void volume.

14. The polishing pad of claim 1, wherein the foundation layer has a hardness approximately in the range of 70-90 Shore D, and the non-continuous polishing surface layer has a hardness approximately in the range of 50-60 Shore D.

15. The polishing pad of claim 1, wherein the foundation layer has a hardness approximately in the range of 70-90 Shore D, and the non-continuous polishing surface layer has a hardness approximately in the range of 20-50 Shore D.

16. The polishing pad of claim 1, wherein the non-continuous polishing surface layer has a first modulus of elasticity, and the foundation layer has a second modulus of elasticity greater than approximately 10 times the first modulus of elasticity.

17. The polishing pad of claim 1, wherein the non-continuous polishing surface layer has a first modulus of elasticity, and the foundation layer has a second modulus of elasticity greater than approximately 100 times the first modulus of elasticity.

18. The polishing pad of claim 1, wherein the non-continuous polishing surface layer has a thickness approximately in the range of 2-50 mils, and the foundation layer has a thickness of greater than approximately 20 mils.

19. The polishing pad of claim 1, further comprising:

a detection region disposed in the foundation layer.

20. The polishing pad of claim 1, further comprising:

an aperture disposed in the polishing pad, through the non-continuous polishing surface layer and the foundation layer; and an adhesive sheet disposed on a back surface of the foundation layer but not in the aperture, the adhesive sheet providing an impermeable seal for the aperture at the back surface of the foundation layer.

21. The polishing pad of claim 1, further comprising:

a sub pad, wherein the foundation layer is disposed proximate to the sub pad.

22. The polishing pad of claim 21, wherein the foundation layer has a hardness approximately in the range of 70-90 Shore D, the non-continuous polishing surface layer has a hardness approximately in the range of 20-60 Shore D, and the sub pad has a hardness less than approximately 90 Shore A.

23. The polishing pad of claim 1, wherein the foundation layer comprises a stack of sub layers.

* * * * *